US005928821A

United States Patent [19]

Garrity, Jr. et al.

[11] Patent Number: 5,928,821

[45] Date of Patent: Jul. 27, 1999

[54] METHOD OF MANUFACTURING A PHOSPHOR SCREEN FOR A CRT

[75] Inventors: Edward Richard Garrity, Jr.; George Milton Ehemann, Jr., both of Lancaster, Pa.

[73] Assignee: Thomson Consumer Electronics, Inc., Indianapolis, Ind.

[21] Appl. No.: 08/577,316

[22] Filed: Dec. 22, 1995

[51] Int. Cl.[6] ..... G03C 5/00

[52] U.S. Cl. ..... 430/23; 430/28

[58] Field of Search ..... 430/23, 25, 26, 430/28; 250/459.1, 461.1

[56] References Cited

U.S. PATENT DOCUMENTS

| | | | |
|---|---|---|---|
| 3,558,310 | 1/1971 | Mayaud | 96/36.1 |
| 4,454,541 | 6/1984 | Duschl | 358/106 |
| 4,542,404 | 9/1985 | Duschl | 358/106 |
| 4,584,481 | 4/1986 | Matey | 250/459.1 |
| 4,917,978 | 4/1990 | Ritt et al. | 430/23 |
| 5,083,959 | 1/1992 | Datta et al. | 445/52 |
| 5,240,798 | 8/1993 | Ehemann, Jr. | 430/28 |
| 5,276,508 | 1/1994 | Boisvert et al. | 358/48 |
| 5,370,952 | 12/1994 | Datta et al. | 430/23 |
| 5,474,866 | 12/1995 | Ritt et al. | 430/23 |

OTHER PUBLICATIONS

"A Frame–Transfer CCD Color Imager with Vertical Anti-blooming," by Van de Steeg et al., IEEE Transactions on Electron Devices (Aug. 1985) vol. ED–32, No. 8, pp. 1430–1438, (Abstract Only), Aug. 1995.

U.S. Pat. Appln., Ser. No. 297,740 filed Aug. 30, 1994 by Ritt et al. Now U.S. Patent 5,474,866.

*Primary Examiner*—Marion McCamish
*Assistant Examiner*—Cheryl Juska
*Attorney, Agent, or Firm*—Joseph S. Tripoli; Dennis H. Irlbeck

[57] ABSTRACT

The present invention relates to a method of electrophotographically manufacturing a phosphor screen 22 comprising a multiplicity of color-emitting screen elements arranged in color groups on an interior surface of a faceplate panel 12 of a color CRT 10. The multiplicity of screen elements is exposed to a source 35 of UV radiation to stimulate the screen elements to emission. The emission from the screen elements is utilized to determine, on a pixel-by-pixel basis, a first emission characteristic of each color group of screen elements. Then, a subsequent manufacturing step (58, 62) is performed that affects the screen elements, and the multiplicity of screen elements is re-exposed to the source of UV radiation to stimulate the screen elements to emission. The resultant emission is utilized to determine, on a pixel-by-pixel basis, a second emission characteristic from each color group of screen elements. The second emission and first emission characteristics are then compared on a pixel-by-pixel basis (60, 64).

2 Claims, 11 Drawing Sheets

Fig. 1
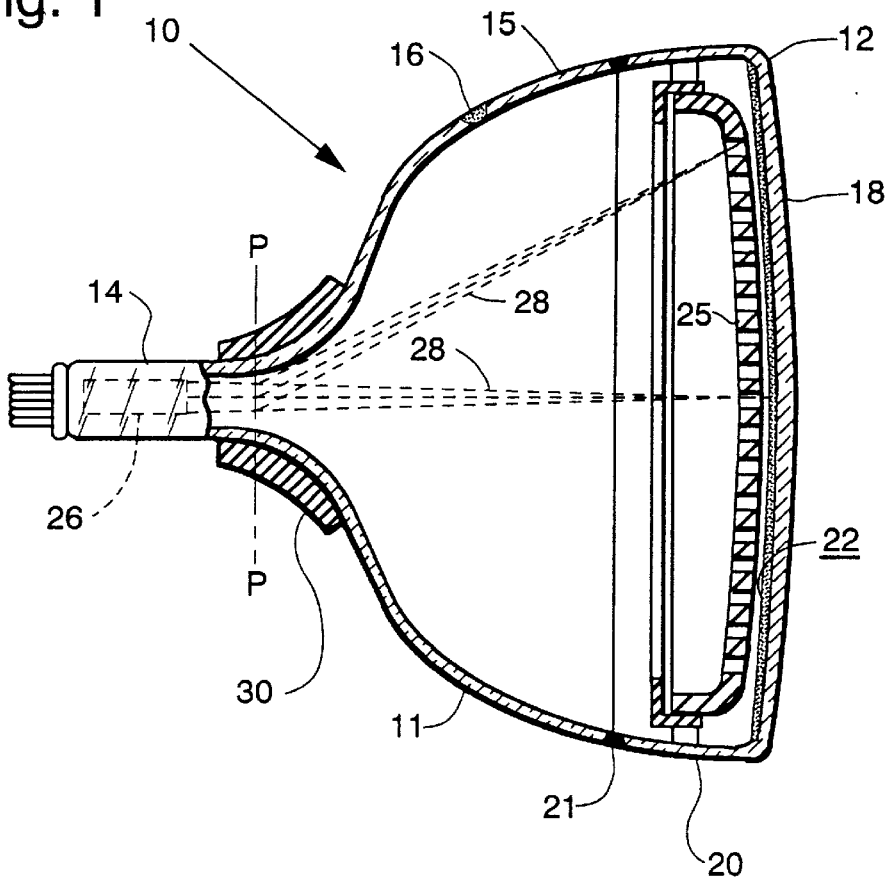
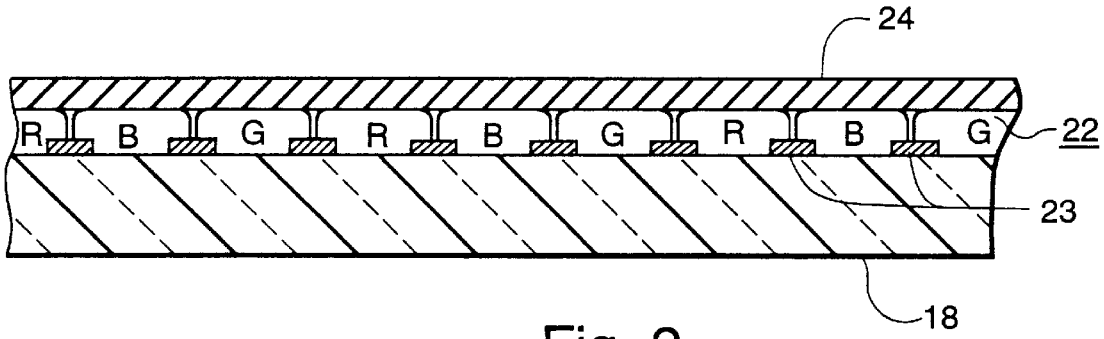
Fig. 2

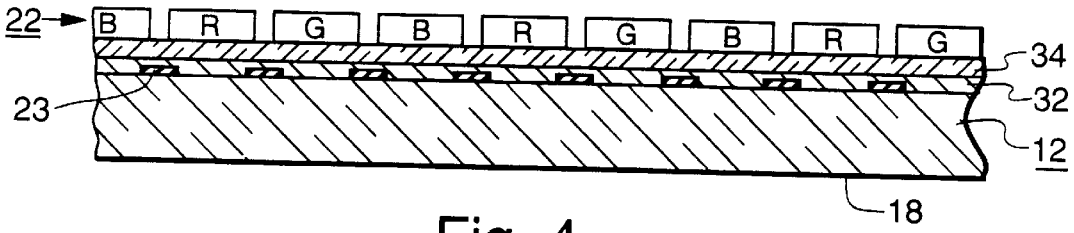
Fig. 4
Fig. 5
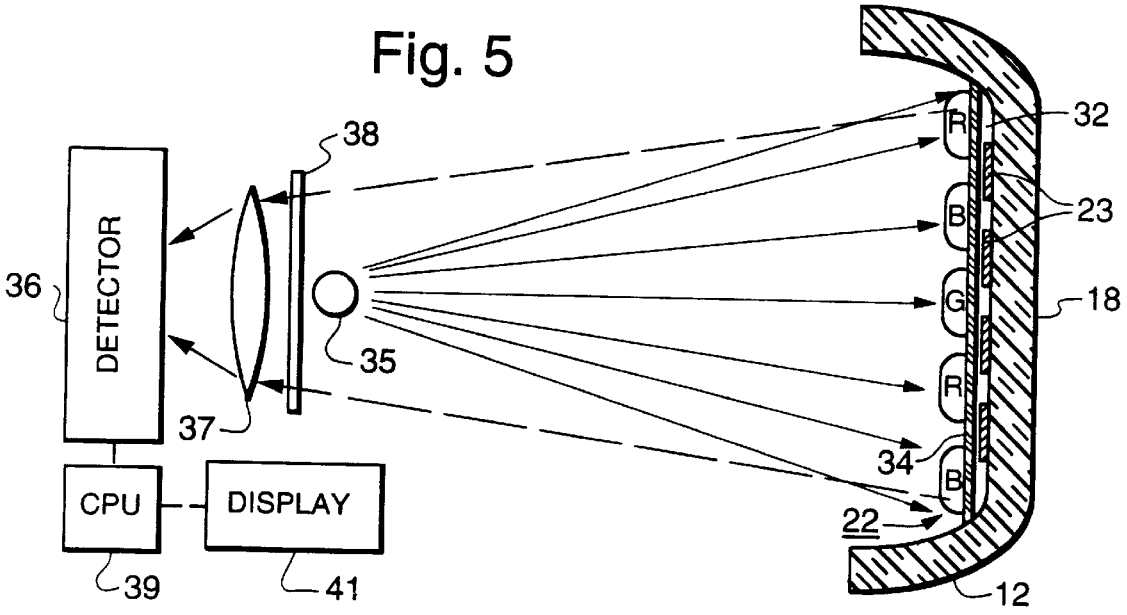

GREEN PHOSPHOR DISTRIBUTION MAP

BLUE PHOSPHOR DISTRIBUTION MAP

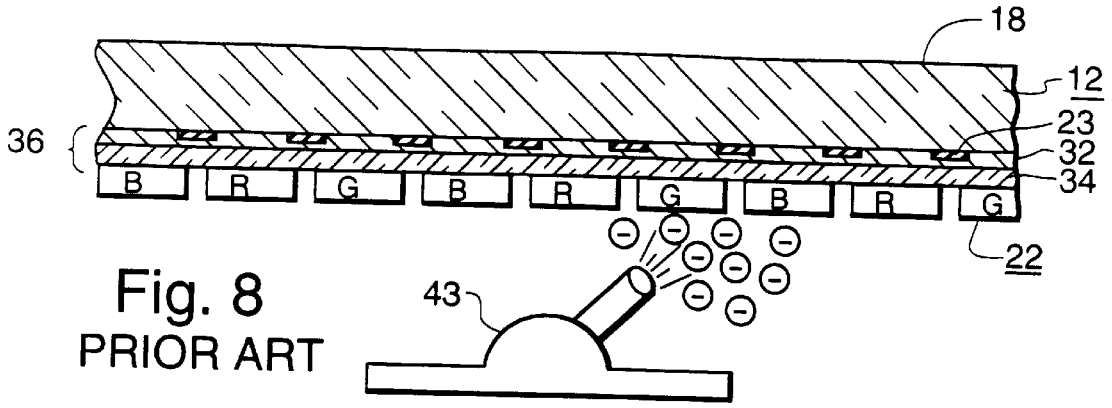
Fig. 8
PRIOR ART
Fig. 9
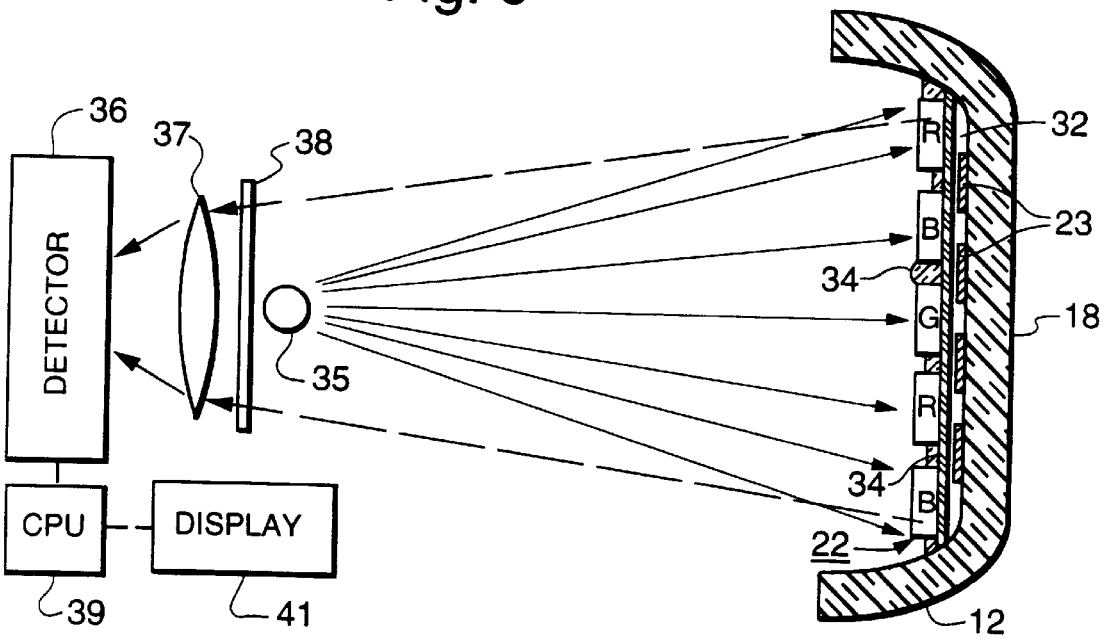

FIXING FACTOR FOR GREEN PHOSPHOR

FIXING FACTOR FOR BLUE PHOSPHOR

Fig. 13 FILMING FACTOR FOR GREEN PHOSPHOR

FILMING FACTOR FOR BLUE PHOSPHOR

METHOD OF MANUFACTURING A PHOSPHOR SCREEN FOR A CRT

The present invention relates to a method of electrophotographically manufacturing a phosphor screen for a cathode-ray tube (CRT), and more particularly to manufacturing a phosphor screen while monitoring certain manufacturing processes.

BACKGROUND OF THE INVENTION

U. S. Pat. No. 4,917,978, issued on Apr. 17, 1990, to Ritt et al., describes a method of manufacturing a screen assembly for a CRT by the electrophotographic screening (EPS) process. The method described in the aforementioned patent includes a "fusing" step followed by a "fixing" step to increase the adherence of the phosphor screen elements to an underlying organic photoconductive (OPC) layer deposited on the interior surface of the CRT faceplate panel. In the fusing step, vapors of a solvent are permitted to contact and soak the OPC layer and the polymeric coupling agent that coats the phosphor materials, to render the layer and the coating tacky. Vapor soaking takes on the order of 4 to 24 hours. The panels are then dried and "fixed" by spraying multiple layers of polyvinyl alcohol (PVA) in an alcohol-water mixture onto the fused phosphor elements. Each spray application requires about 2 to 5 minutes to achieve complete screen coverage. The "fixed" screens are then filmed, either by convention spray or emulsion filming. It has been determined that the PVA spray applications tend to move the phosphor elements slightly, which might be unacceptable, depending on the amount of movement.

U.S. Pat. No. 5,474,866, issued to Ritt et al., on Dec. 12, 1995 describes a method for fixing the phosphor elements to the underlying OPC layer, by electrostatically spraying a suitable fixative. The fixative dissolves the OPC layer in such a manner that the phosphor elements are at least partially encapsulated by the OPC layer, without causing any movement of the phosphors. An inspection of the phosphor side of the faceplate panel, with a UV source, after fixing, stimulates the phosphor elements to emit visible light. The visible light output from the phosphor screen elements shows patterns consisting of light and dark regions, with several gradations of shading therebetween. The dark regions indicate greater encapsulation, or coverage, of the phosphor elements by the OPC layer during fixing. In regions where the OPC layer encapsulates the phosphor elements, it absorbs some of the incident UV radiation and also absorbs some of the emitted visible light, thereby reducing the light output of the encapsulated phosphor elements, making them appear darker than the phosphor elements that are only partially encapsulated. After fixing, the phosphor screen is filmed by providing a layer of a suitable acrylic resin that overlies the phosphor elements and forms a smooth surface on which an aluminum layer subsequently is deposited. Inspection of filmed phosphor screens with a UV source also stimulates the phosphor elements to emit visible light. Because the filming material completely covers the phosphor elements, the light output of the phosphor elements, after filming, is more attenuated than before filming. This difference in light output provides an indication of the thickness and uniformity of the filming layer. It is desirable to utilize the light output information, provided by UV exposure of both the fixed and filmed phosphor screens, to establish process controls and optimize the fixing and filming steps in the manufacturing operation.

SUMMARY OF THE INVENTION

In accordance with the present invention, a method of electrophotographically manufacturing a phosphor screen, comprising a multiplicity of color-emitting screen elements arranged in color groups on an interior surface of a faceplate panel of a CRT, is described. The multiplicity of screen elements is exposed to a source of UV radiation to stimulate the screen elements to emission. The emission from the screen elements is utilized to determine, on a pixel-by-pixel basis, a first emission characteristic for each color group of screen elements. Then, a subsequent manufacturing step is performed that affects the screen elements. The multiplicity of screen elements is re-exposed to the source of UV radiation to stimulate the screen elements to emission. The resultant emission is utilized to determine, on a pixel-by-pixel basis, a second emission characteristic for each color group of screen elements. The second emission and first emission characteristics are then compared on a pixel-by-pixel basis for each color group of screen elements.

BRIEF DESCRIPTION OF THE DRAWINGS

The invention will now be described in greater detail, with relation to the accompanying drawings, in which:

FIG. 1 is a plan view, partially in axial section, of a color CRT made according to the present invention;

FIG. 2 is a section of a faceplate panel of the CRT of FIG. 1, showing a phosphor screen assembly;

FIG. 4 shows a step in the manufacturing process in which a multiplicity of color-emitting phosphor screen elements are deposited onto an OPC layer;

FIG. 5 is a schematic representation of a test setup to monitor the color-emitting phosphor screen elements of FIG. 4;

FIG. 8 shows a subsequent fixing step in the manufacturing process;

FIG. 9 is a schematic representation of the test setup to monitor the effect of the fixing step of FIG. 8 on the color-emitting screen elements;

DETAILED DESCRIPTION OF THE PREFERRED EMBODIMENTS

Figure 3:
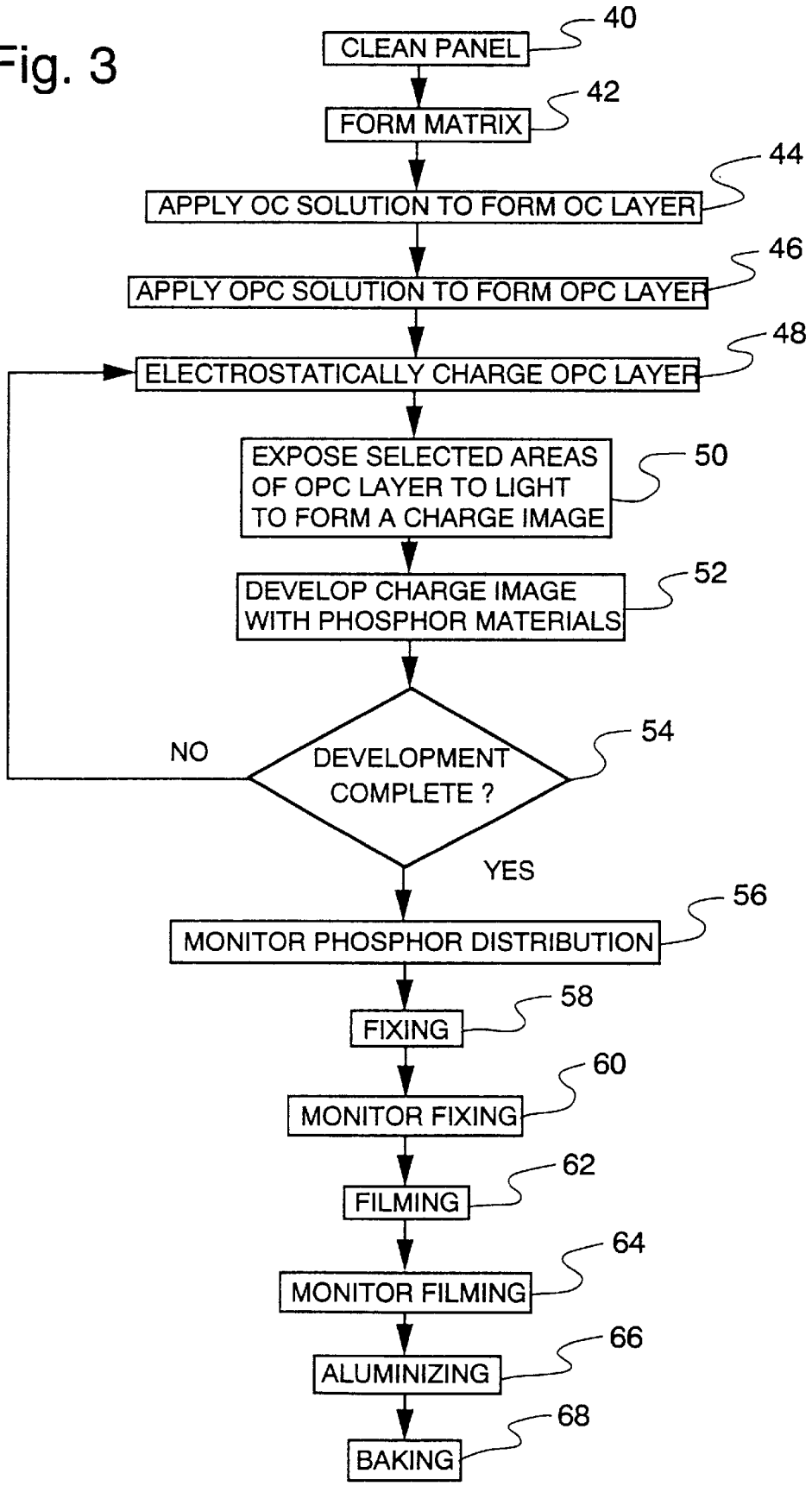
FIG. 3 is a block diagram comprising a flow chart of the manufacturing process involved.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A luminescent three color phosphor screen 22 is carried on the inner surface of the faceplate 18. The screen 22, shown in FIG. 2, is a line screen that includes a multiplicity of screen elements composed of red-emitting, green-emitting and blue-emitting phosphor stripes R, G, and B, respectively, arranged in color groups or picture elements of three stripes or triads, in a cyclic order. The stripes extend in a direction that is generally normal to the plane in which the electron beams are generated. In the normal viewing position of the embodiment, the phosphor stripes extend in the vertical direction. Preferably, at least portions of the phosphor stripes overlap a relatively thin, light absorptive matrix 23, as is known in the art. Alternatively, the matrix can be formed after the screen elements are deposited, in the manner described in U.S. Pat. No. 5,240,798, issued to Ehemann, Jr., on Aug. 31, 1993. A dot screen also may be formed by the novel process. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields that cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

The screen is manufactured by an electrophotographic screening (EPS) process that is shown schematically in FIG. 3. Initially, the panel 12 is cleaned, as indicated by reference numeral 40, by washing it with a caustic solution, rinsing it in water, etching it with buffered hydrofluoric acid and rinsing it again with water, as is known in the art. The interior surface of the viewing faceplate 18 is then provided with the light absorbing matrix 23, as indicated by reference numeral 42, preferably, using the conventional wet matrix process described in U.S. Pat. No. 3,558,310, issued to Mayaud on Jan. 26, 1971. In the wet matrix process, a suitable photoresist solution is applied to the interior surface, e.g., by spin coating, and the solution is dried to form a photoresist layer. Then, the shadow mask is inserted into the panel and the panel is placed onto a three-in-one lighthouse that exposes the photoresist layer to actinic radiation from a light source that projects light through the openings in the shadow mask. The exposure is repeated two more times with the light source located to simulate the paths of the electron beams from the three electron guns. The light selectively alters the solubility of the exposed areas of the photoresist layer where phosphor materials will subsequently be deposited. After the third exposure, the panel is removed from the lighthouse and the shadow mask is removed from the panel. The photoresist layer is developed, using water, to remove the more soluble areas thereof, thereby exposing the underlying interior surface of the faceplate, and leaving the less soluble, exposed areas of the photoresist layer intact. Then, a suitable solution of light-absorbing material is uniformly provided onto the interior surface of the faceplate 18 to cover the exposed portion of the faceplate and the retained, less soluble, areas of the photoresist layer. The layer of light-absorbing material is dried and developed using a suitable solution that will dissolve and remove the retained portion of the photoresist layer and the overlying light-absorbing material, forming windows in the matrix layer that is adhered to the interior surface of the faceplate. For a panel 12 having a diagonal dimension of 51 cm (20 inches), the window openings formed in the matrix have a width of about 0.13 to 0.18 mm, and the matrix lines have a width of about 0.1 to 0.15 mm.

The interior surface of the faceplate 18, having the matrix 23 thereon, is then coated with a suitable solution of a volatilizable, organic conductive (OC) material to form an OC layer 32, as indicated by reference numeral 44, that provides an electrode for an overlying volatilizable, organic photoconductive (OPC) layer 34. The OC layer 32 and the OPC layer 34 are shown in FIG. 4.

Suitable materials for the OC layer 32 include certain quaternary ammonium polyelectrolytes recited in U.S. Pat. No. 5,370,952, issued to Datta et al. on Dec. 6, 1994. Preferably, the OPC layer 34 is formed, as indicated by reference numeral 46, by coating the OC layer 32 with a solution containing polystyrene; an electron donor material, such as 1,4-di(2,4-methyl phenyl)-1,4 diphenylbutatriene; electron acceptor materials, such as 2,4,7-trinitro-9-fluorenone and 2-ethylanthroquinone; and a solvent, such as toluene or xylene. A surfactant, such as silicone U-7602 and a plasticizer, such as dioctyl phthalate, also may be added to the solution. The surfactant U-7602 is available from Union Carbide, Danbury Conn.

The OPC layer 34 is uniformly electrostatically charged, as indicated by reference numeral 48, using a corona discharge device, not shown, that is described in U.S. Pat. No. 5,083,959, issued on Jan. 28, 1992, to Datta et al. The OPC layer 34 is charged to a voltage within the range of approximately +200 to +700 volts. The shadow mask 25 is then inserted into the panel 12, which is placed onto a lighthouse, also not shown, and the positively charged OPC layer 34 is exposed, through the shadow mask 25, to light from a suitable light source disposed within the lighthouse. The light passes through the apertures in the shadow mask 25, at an angle identical to that of one of the electron beams from the electron gun of the tube, and discharges the illuminated areas on the OPC layer 34 on which it is incident to form a charge image, as indicated by reference numeral 50. The shadow mask is removed from the panel 12, and the panel is placed onto a first phosphor developer containing a first color-emitting phosphor material, to develop the charge image, as indicated by reference numeral 52. The first color-emitting phosphor material is positively triboelectrical charged within the developer and directed toward the OPC layer 34. The positively charged first color-emitting phosphor material is repelled by the positively charged areas on the OPC layer 34 and deposited onto the discharged areas thereof by the process known in the art as "reversal" development. In reversal development, triboelectrically charged particles of screen structure material are repelled by similarly charged areas of the OPC layer 34 and deposited onto the discharged areas thereof. The size of each of the lines of the first color-emitting phosphor elements is slightly larger than the size of the openings in the light-absorbing matrix to provide complete coverage of each opening, and a slight overlap of the light-absorbing matrix material surrounding the openings. Because a total of three different color-emitting phosphors are required to form the phosphor screen 22, the development, as indicated by reference numeral 54 is not complete. Accordingly, the panel 12 is electrostatically recharged, as indicated by reference numeral 48, using the above-described corona discharge apparatus. A positive voltage is established on the OPC layer 34 and on the first color-emitting phosphor material deposited thereon. The light exposure step 50 and the phosphor development step 52 are repeated for each of the two remaining color-emitting phosphors. The size of each of the lines of the other two color-emitting phosphor elements on the OPC layer 34 also is larger than the size of the matrix openings, to ensure that no gaps occur and that a slight overlap of the light-absorbing matrix material surrounding the openings is provided. The resultant phosphor screen 22 is shown in FIG. 4.

The quality of the phosphor screen 22 is monitored by the setup shown in FIG. 5. In this instance, the quality of the screen refers to the distribution of the different color-emitting phosphor elements and their light output, compared to the light output of separate, uniform blue, green and red fields. A radiation source 35, such as an ultraviolet flood light having a peak emission at a wavelength of 365 nanometer, is positioned at a distance of about 1 meter from the phosphor screen 22 on the faceplate panel 12. UV radiation from the source 35 is incident on the blue-, green- and red-emitting elements of the phosphor screen 22. A detector, such as a CCD camera 36, also is positioned about 1 meter from the phosphor screen 22, in a position to one side of the source 35. UV radiation incident on the phosphor screen 22 stimulates the phosphors of the screen 22 to emit visible light. The light emitted by the phosphors of the screen 22 is propagated in directions defined by a Lambertian-type function. The light directed back toward the source is focused on the CCD camera 36 by a lens 37. The CCD camera 36 has three channels, a blue, a green and a red channel, each of which contains a 480×512 pixel CCD. As is known in the art, the CCD camera 36 splits the incoming light into blue, green and red components from the blue-, green- and red-emitting phosphors of the screen 22. A UV filter 38 is disposed between the UV radiation source 35 and the CCD camera 36 to block any UV radiation, emitted by the source 35, from entering the CCD camera. The UV filter 38 may be any non-UV transmitting glass or plastic, such as LEXANT™, available from General Electric Co., Pittsfield, Mass.

The CCD camera 36 is calibrated by focusing the camera on a blue, a green and a red phosphor standard, or field, not shown, that are exposed to UV radiation from the source 35. It is known that while the CCD camera has three separate channels, one for the blue, one for the green, and one for the red light incident thereon, the separation of the basic colors within the CCD camera is not total, so that some "cross-talk" occurs between the channels. In other words, even when the camera 36 is focused on the blue standard, some of the blue light also is sensed by the CCD's of the green and the red channels of the CCD camera. Thus, it is necessary to determine the effective portion of the basic phosphor colors received by each channel of the CCD camera. According to known calorimetric procedures, this is done by mathematically inverting the array of channel readings, including cross-talk, produced by the separate basic phosphor colors. Then, by pre-multiplying the three channel readings of the CCD camera by the inverted number array, derived from the channel readings obtained during this calibration step, the cross-talk is properly subtracted, and three new numbers are obtained which represent the basic colors from the three color-emitting phosphor elements.

After the calibration is complete, the distribution of the light from each of the color-emitting phosphor elements of the screen 22 can be measured and compared to the corresponding standard for that color. The light from the phosphor elements, or pixels, of the screen 22, that are stimulated to emission by the UV source 35, is focused into the CCD camera 36 by the lens 37. Each pixel generates signals in the three CCD channels. The output signals of the CCD's are connected to a computer 39 that contains image processing software that transforms the signals from each pixel into its basic color components that represent the light output data received from the screen 22. The light output data is thereby transformed into a data array comprising seventeen data points along the major axis, X, and thirteen data points along the minor axis, Y, of the screen. The light output data is communicated to a display device 41, such as a TV screen, a printer, or both.

Figure 6:
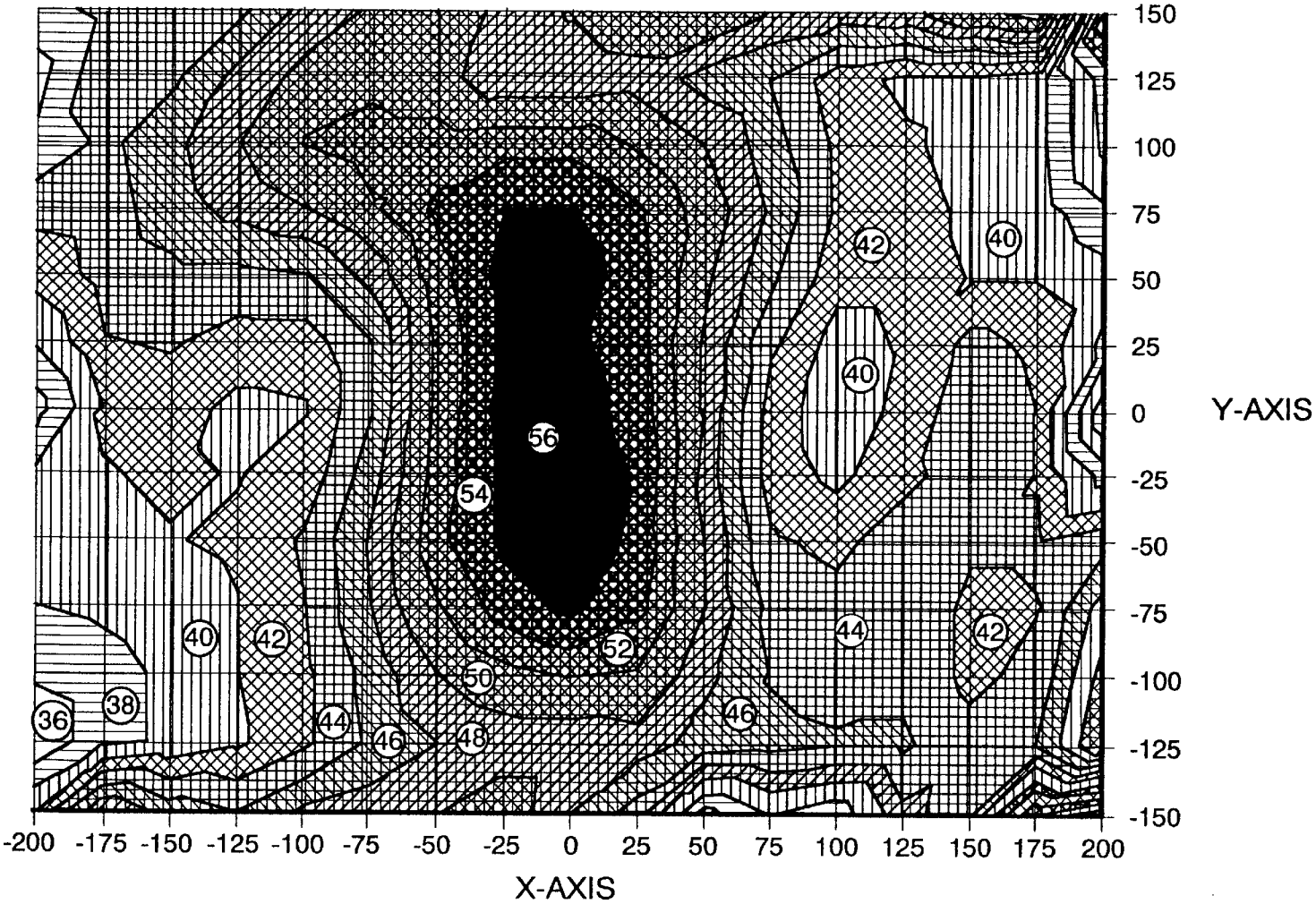
FIG. 6 is a distribution map of the light output of the green-emitting phosphor elements for the test setup of FIG. 5.

A distribution map of the light output of each phosphor color, with the various regions of the screen 22 represented as a percent of the brightness of the standard field, is generated for each phosphor screen 22 that is manufactured. The distribution map of the light output of the green phosphor elements of one such screen 22 is shown in FIG. 6. The light output of the green phosphor elements of the screen 22 are shown, on a pixel-by-pixel basis, and the brightness is expressed as a percentage of the brightness of the standard green field. FIG. 6 indicates that the green light output of the test screen 22 ranges from about 36 to 56% of the light output of the standard green field. This is understandable because the standard fields are made-up of thick phosphor samples of relatively large area, whereas the EPS phosphor screen elements are formed as thin lines with considerable porosity and a thickness substantially less than that of the standard fields.

Figure 7:
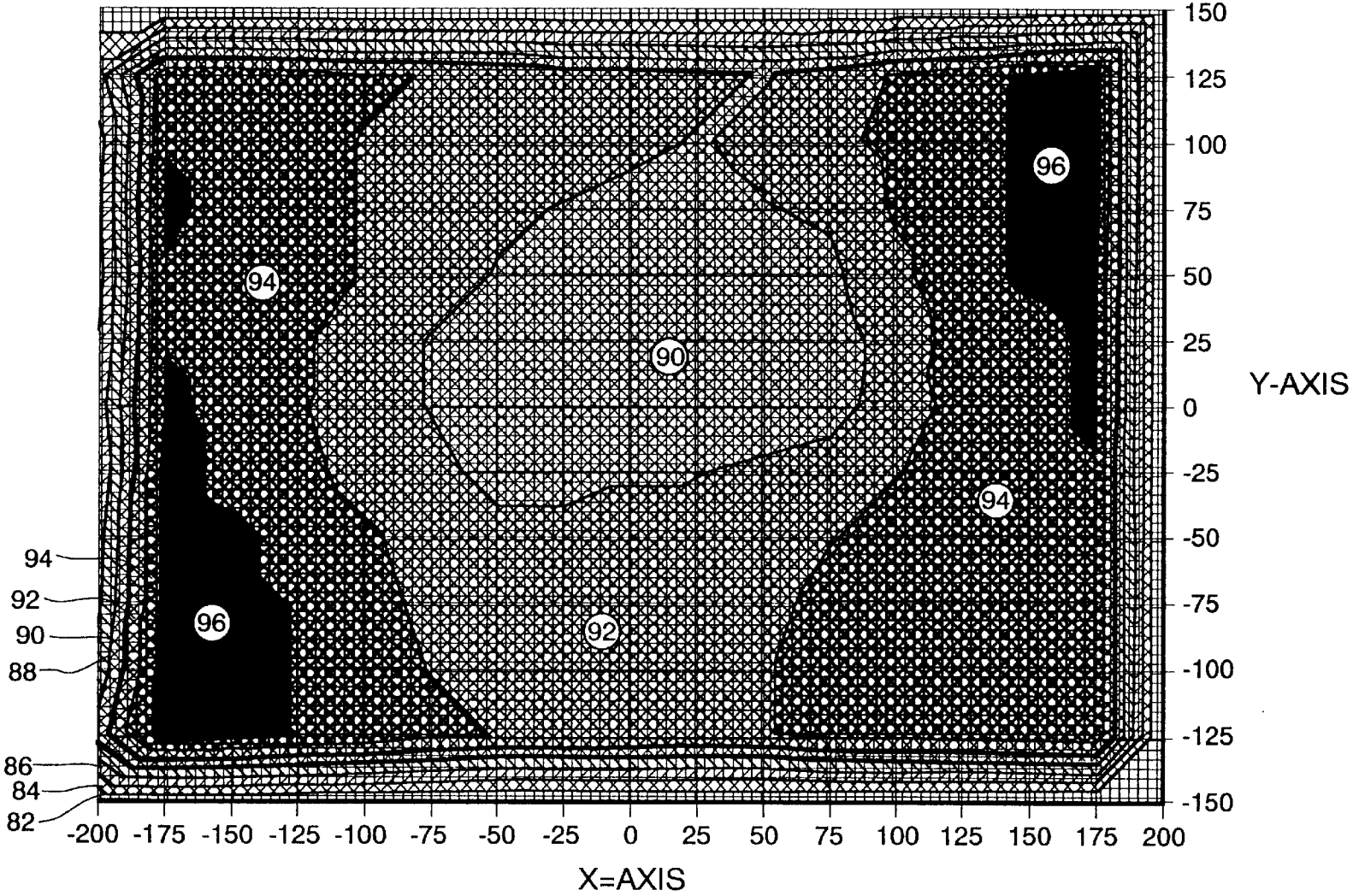
FIG. 7 is a distribution map of the light output of the blue-emitting phosphor elements for the test setup of FIG. 5.

FIG. 7 is a distribution map of the light output of the blue color-emitting phosphor elements on a screen 22. It should be noted that the distribution of brightness for the blue color-emitting phosphor elements is different not only in shape but in intensity compared to the green-emitting phosphor elements of FIG. 6. The light intensity of the blue phosphor elements ranges from 90 to 96% of the blue standard. A similar measurement of the light output of the red-emitting phosphor elements is also made, but the distribution map is not shown because the method of the present invention can be understood utilizing only the green and blue phosphor elements. The phosphor distribution maps of FIGS. 6 and 7 are used, in conjunction with other inspections of the completed phosphor screen 22, to determine the completeness of phosphor coverage of the matrix openings and overall screen quality.

The three light-emitting phosphors are fixed to the above-described OPC layer 34 in a subsequent manufacturing step, as indicated in FIG. 3 by numeral 58. The phosphors elements are contacted with a suitable fixative that is electrostatically charged by an electrostatic spray gun 43, shown in FIG. 8. Suitable fixatives include such solvents as acetone; amyl acetate; butyl acetate; methyl isobutyl ketone (MIBK); methyl ethyl ketone (MEK); toluene; xylene; as well as polymeric solutions, such as acrylic resin dissolved in MIBK; and poly-alphamethyl styrene (AMS) dissolved in MIBK. Any one of the above-mentioned solvents may be used to fix the phosphors to the underlying OPC layer 34. The preferred electrostatic spray gun is an AERO-BELLTM™ model, available from ITW Ransburg, Toledo, Ohio. The electrostatic gun provides negatively charged droplets of uniform size that wet the phosphor screen elements and the underlying OPC layer 34, without moving the phosphors. As shown in FIG. 8, the panel 12 is oriented with the OPC layer 34 and the phosphor screen elements directed downwardly, toward the electrostatic gun 43. The downward orientation of the panel 12 prevents any large droplets, forming on the electrostatic gun 43, from dropping onto the screen 22 and moving the phosphor elements. The polystyrene used in the OPC layer 34 is completely soluble in amyl acetate, butyl acetate, MIBK, toluene and xylene, and partially soluble in acetone, the former all having a boiling point within the range of 100 to 150° C. MIBK, however, is preferred because it dissolves the polystyrene of the OPC layer 34 more slowly than the other solvents, and encapsulates the phosphor elements without moving them.

Figure 10:
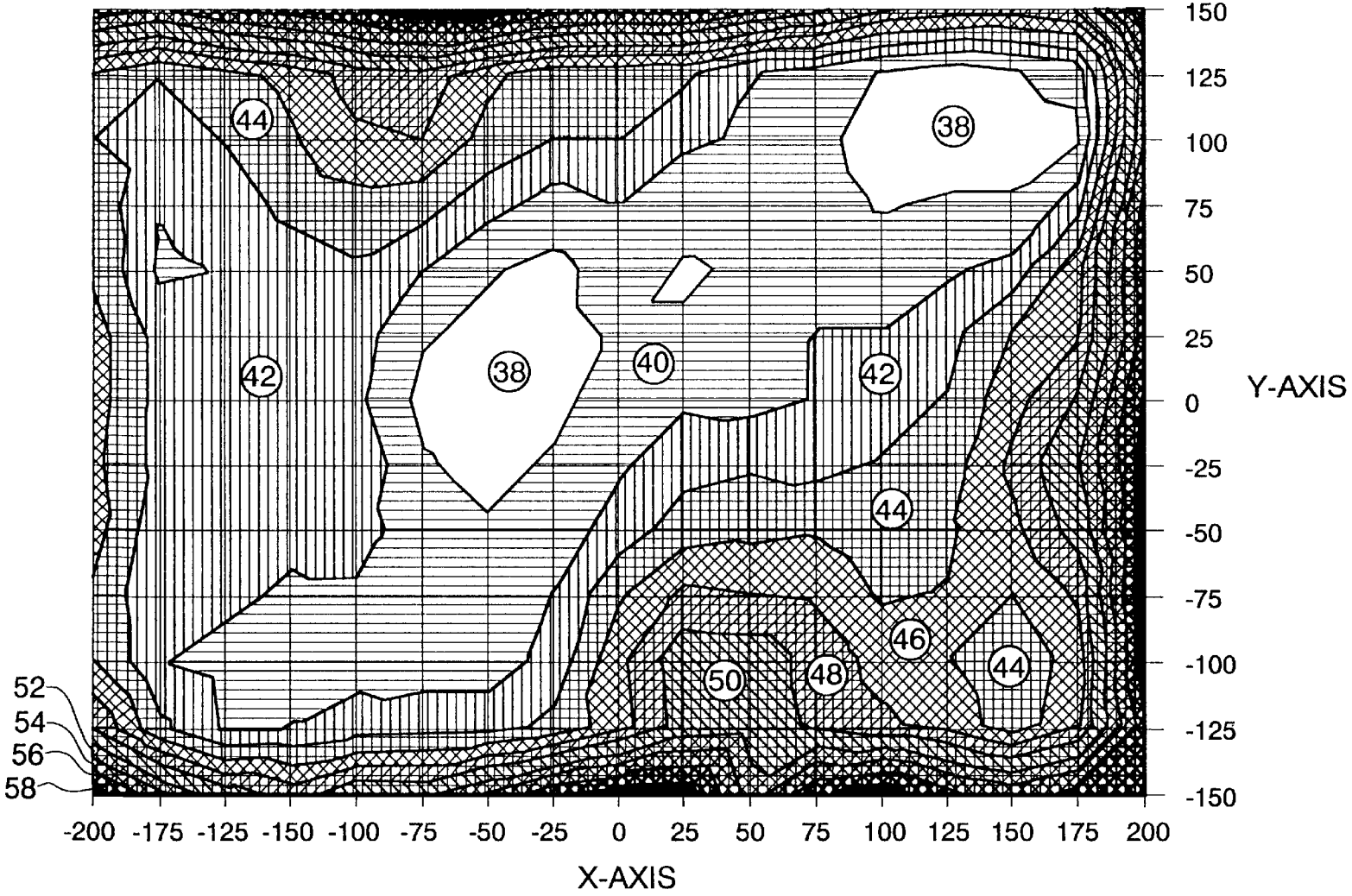
FIG. 10 is a distribution map of the difference in light output of the green-emitting phosphor elements as a result of the fixing step.
Figure 11:
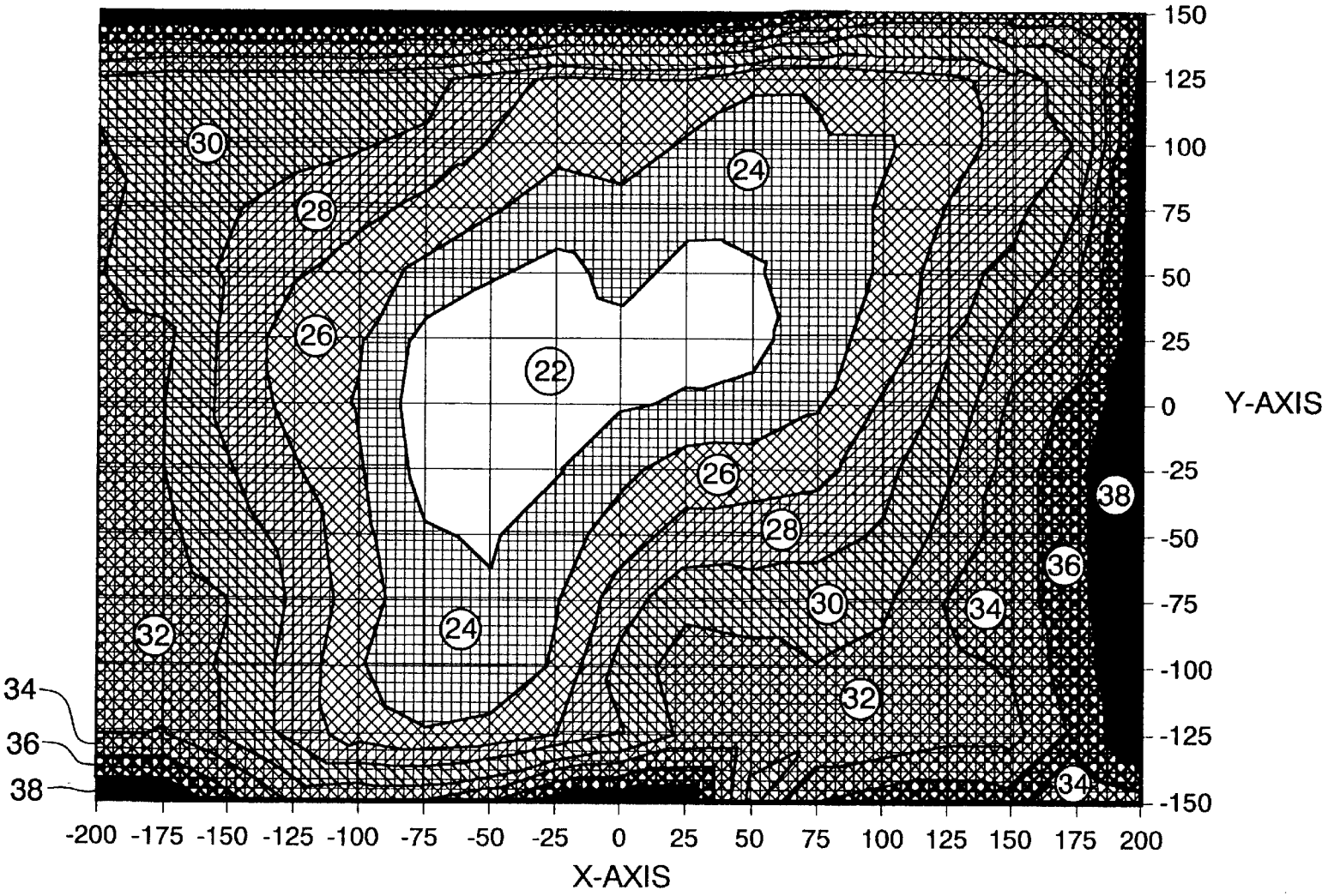
FIG. 11 is a distribution map of the difference in light output of the blue-emitting phosphor elements as a result of the fixing step.

The degree of encapsulation of the phosphor elements is determined by monitoring the fixing step, indicated by numeral 60 in FIG. 3, using the same test apparatus as used to monitor the phosphor distribution. As shown in FIG. 9, the fixing step causes the OPC layer 34 to encapsulate at least a portion of each of the phosphor screen elements. By exposing the screen 22, after fixing, to UV radiation from the source 35 and imaging the light output of the screen through the lens 37 onto the CCD camera 36, the extent of encapsulation, or the "fixing factor" can be determined. The "fixing factor" for light emitted by the green phosphor elements is shown in FIG. 10. The light emitted by the elements, or pixels, of the screen 22, that are stimulated to emission by the UV source 35, is focused into the CCD camera 36 by the lens 37. Each pixel generates signals in the three CCD channels. The output signals of the CCD's are connected to the computer 39 that contains image processing software. The software transforms the signals received from each pixel, into its basic color components that represent the light output data received from the screen 22, after fixing. The light output data is thereby transformed into a data array comprising seventeen data points along the major axis, X, and thirteen data points along the minor axis, Y, of the screen. This light output data is compared, on a pixel-by-pixel basis, to the light output data, or first emission characteristic, from each of the color-emitting elements, before fixing. The light output ratio, resulting from this comparison, is communicated to the display device 41, which provides a distribution map, such as that shown in FIG. 10 for the green-emitting phosphor elements. The light output from the green-emitting phosphor elements, after fixing, ranges from 38 to 54 percent of the light output before fixing. Using the same test procedure, the "fixing factor" for the blue-emitting screen elements is shown in FIG. 11. In this instance the blue light output of the screen 22, after fixing, ranges from 22 to 38% of the blue light output before fixing, i.e., of the blue light output of the phosphor screen elements.

Figure 12:
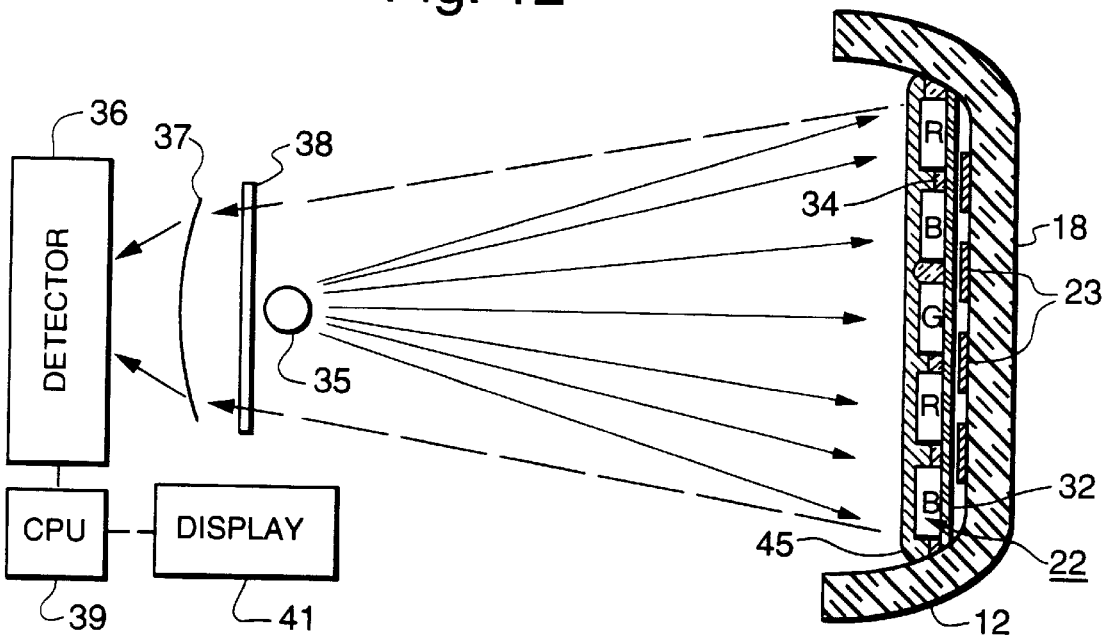
FIG. 12 is a schematic representation of the test setup to monitor the effect of a filming step on the color-emitting screen elements.
Figure 13:
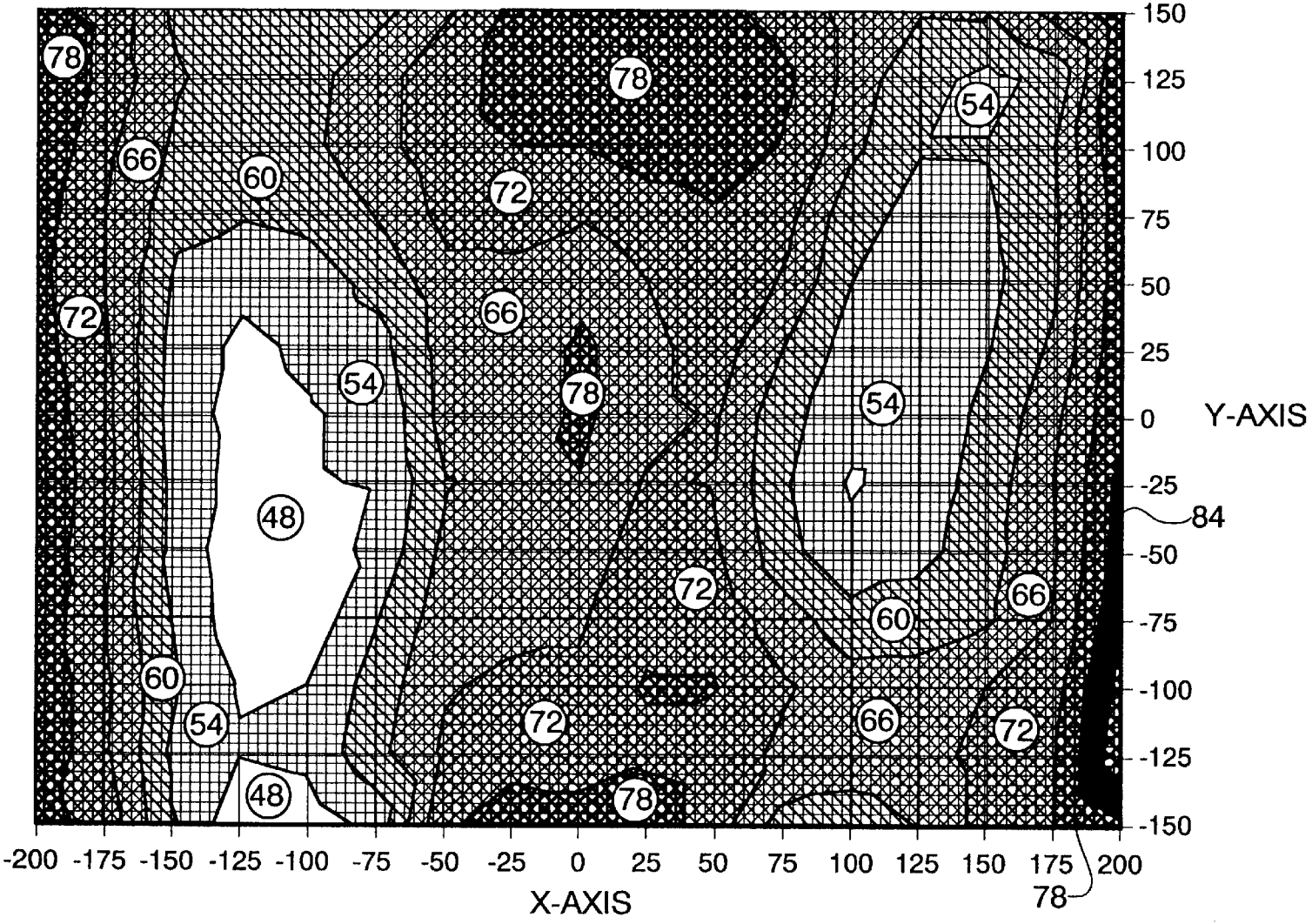
FIG. 13 is a distribution map of the difference in light output of the green-emitting phosphor elements as a result of the filming step.
Figure 14:
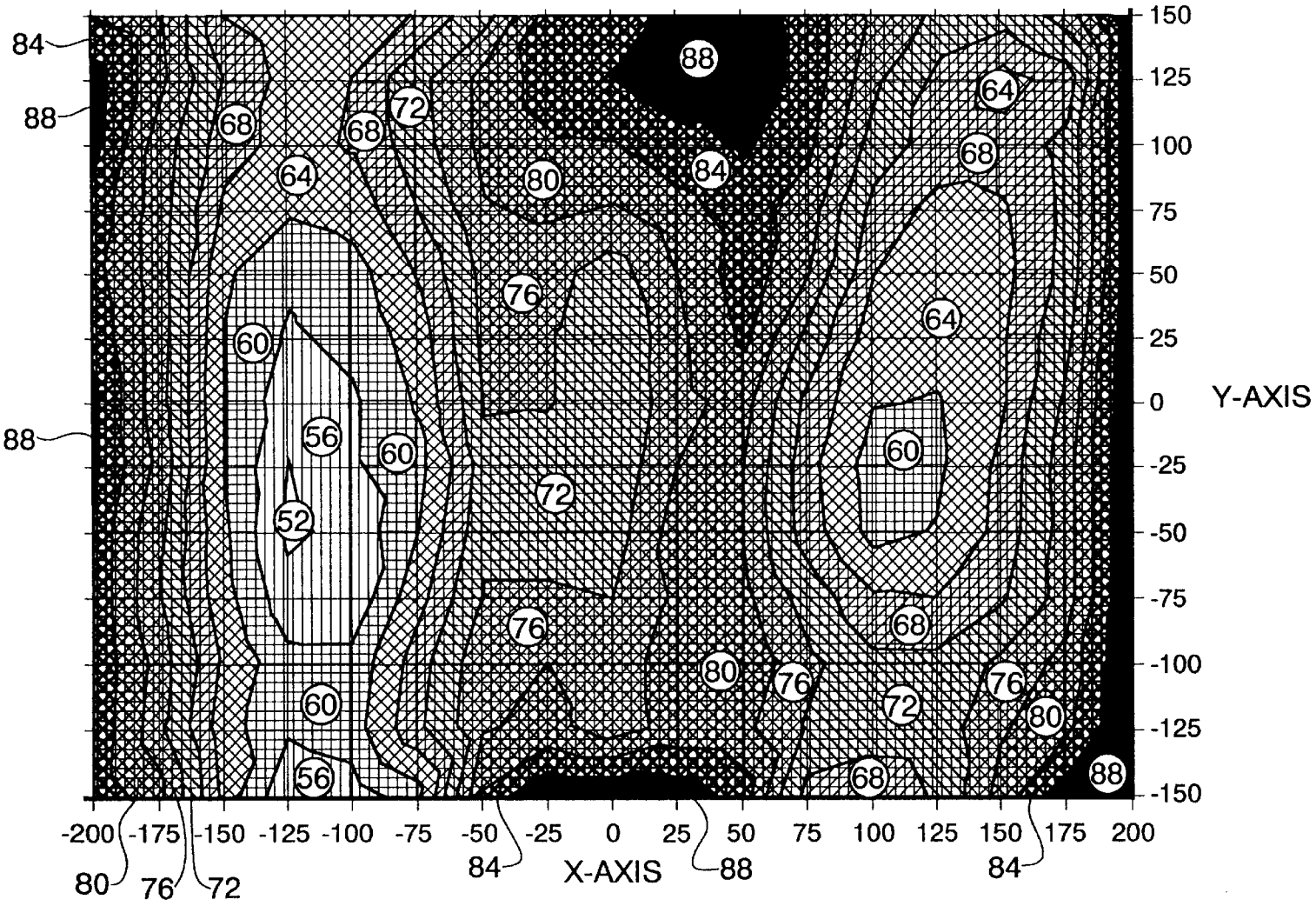
FIG. 14 is a distribution map of the difference in light output of the blue-emitting phosphor elements as a result of the filming step.

The phosphor screen is then filmed, in yet another manufacturing step, as indicated in FIG. 3 by numeral 62, to provide a layer 45, shown in FIG. 12, that forms a smooth surface, which completely covers the phosphor elements of the screen 22. The aluminum layer 24 subsequently will be deposited onto the film layer 45. The film, preferably, is deposited by electrostatically spraying a polymeric solution over the phosphor screen elements. The preferred filming solution is an acrylic resin dissolved in MIBK. Good results have been obtained using a resin, available from Pierce and Stevens, Buffalo, N.Y., comprising about 90 wt. % of polymethyl methacrylate, 9 wt. % of isobutyl methacrylate, and the balance being the plasticizer DOP, and nitrocellulose. The resin solids comprise about 3 to 10 wt. % of the filming solution. Alternatively, emulsion filming, as is known in the art can be used to form the filming layer, however, a suitable dye, such as 0.2 wt. % of quinoline, should be added to the emulsion filming solution to facilitate measurement of the film layer. The effectiveness of the filming, and indirectly the film thickness, is determined by comparing the light output of the phosphor screen elements before and after filming, using the test setup shown in FIG. 12, which is the same as the setup described above, using the same UV radiation source and CCD camera. The luminance of the phosphor screen is dependent on how much UV radiation reaches the screen elements. However, the optical attenuation of the filming material is similar for all the wavelengths of interest, UV through red, so that for the present purpose no special correction for non-uniform attenuation is necessary. As shown in FIG. 13, the "filming factor," or light distribution, for the green light-emitting phosphor elements ranges from about 54 to 84%. This means that the light output of the green phosphor elements, after filming, is reduced by the indicated percentage from the light output before filming, i.e., to the green light output after fixing. FIG. 14 shows that the "filming factor" for the blue light-emitting phosphor elements ranges from about 52 to 88% of the light output before filming.

With the information provided by monitoring the fixing and filming steps in the manufacturing process, the fixing and/or filming parameters can be adjusted to control the amount of phosphor encapsulation or film thickness and, ultimately, the quality of the phosphor screen 22.

After filming, the phosphor screen 22 is aluminized, as indicated by reference numeral 66, to form a screen assembly, and baked, as indicated by reference numeral 68, at a temperature of about 425° C., for about 30 minutes, to remove the volatilizable constituents, such as the OC layer 32, the OPC layer 34 and the filming layer 45.

What is claimed is:

1. A method of electrophotographically manufacturing a phosphor screen on an interior surface of a faceplate panel of a CRT comprising the steps of:

a) forming a matrix on said interior surface of said faceplate panel;

b) overcoating said matrix with a volatilizable, organic conductive (OC) layer;

c) providing a volatilizable, organic photoconductive (OPC) layer overlying said OC layer;

d) serially depositing a multiplicity of first color-emitting, second color-emitting and third color-emitting phosphor screen elements, arranged in color groups, onto said OPC layer, overlying openings in said matrix, e) flood exposing said multiplicity of screen elements of said phosphor screen to a source of UV radiation to stimulate said screen elements to emit visible light;

f) imaging each color group of screen elements onto a CCD camera having three channels to determine, on a pixel by pixel basis, a first light output of each color group of screen elements;

g) performing a subsequent manufacturing step affecting said screen elements;

h) flood re-exposing said multiplicity of screen elements to said source of UV radiation to stimulate said screen elements to emit visible light;

i) imaging each color group of screen elements onto said CCD camera to determine, on a pixel-by-pixel basis, a second light output from each color group of screen elements;

j) comparing, pixel-by-pixel, said second light output to said first light output to obtain a difference image for each channel; and k) utilizing said difference image to initiate a local process to monitor and adjust said subsequent manufacturing step to control the quality of said phosphor screen.

2. The method as described in claim 1, further including, after step k), the additional steps of:

j) filming said phosphor screen;

k) aluminizing said phosphor screen to form a screen assembly; and l) baking said screen assembly at an elevated temperature to remove the volatilizable constituents therefrom.

* * * * *